US009392364B1

(12) United States Patent
Milani et al.

(10) Patent No.: US 9,392,364 B1
(45) Date of Patent: Jul. 12, 2016

(54) VIRTUAL MICROPHONE FOR ADAPTIVE NOISE CANCELLATION IN PERSONAL AUDIO DEVICES

(71) Applicant: Cirrus Logic, Inc., Austin, TX (US)

(72) Inventors: Ali Abdollahzadeh Milani, Austin, TX (US); Antonio John Miller, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 363 days.

(21) Appl. No.: 13/968,013

(22) Filed: Aug. 15, 2013

(51) Int. Cl.
*H04R 3/00* (2006.01)

(52) U.S. Cl.
CPC ..... *H04R 3/002* (2013.01)

(58) Field of Classification Search
CPC ..... G10K 11/178; H04R 1/1083; H04R 2410/05; F01N 1/065
USPC ..... 381/71.1, 71.5–71.8, 71.11
See application file for complete search history.

(56) References Cited

U.S. PATENT DOCUMENTS

| | | | |
|---|---|---|---|
| 5,251,263 | A | 10/1993 | Andrea et al. |
| 5,278,913 | A | 1/1994 | Delfosse et al. |
| 5,321,759 | A | 6/1994 | Yuan |
| 5,337,365 | A | 8/1994 | Hamabe et al. |
| 5,359,662 | A | 10/1994 | Yuan et al. |
| 5,410,605 | A | 4/1995 | Sawada et al. |
| 5,425,105 | A | 6/1995 | Lo et al. |
| 5,445,517 | A | 8/1995 | Kondou et al. |
| 5,465,413 | A | 11/1995 | Enge et al. |
| 5,481,615 | A | 1/1996 | Eatwell et al. |
| 5,548,681 | A | 8/1996 | Gleaves et al. |

(Continued)

FOREIGN PATENT DOCUMENTS

| | | | |
|---|---|---|---|
| CN | N105284126 | A | 1/2016 |
| CN | N105308678 | A | 2/2016 |

(Continued)

OTHER PUBLICATIONS

Widrow, B. et al., Adaptive Noise Cancelling: Principles and Applications, Proceedings of the IEEE, IEEE, New York, NY, U.S., vol. 63, No. 13, Dec. 1975, pp. 1692-1716.

(Continued)

*Primary Examiner* — Duc Nguyen
*Assistant Examiner* — George Monikang
(74) *Attorney, Agent, or Firm* — Jackson Walker L.L.P.

(57) ABSTRACT

A processing circuit may implement an adaptive filter having a response that generates an anti-noise signal from a reference microphone signal, one or more filters for modeling an electro-acoustic path of the anti-noise signal from a location of an error microphone to an eardrum of a listener and having a response that generates a filtered reference microphone signal from the reference microphone signal, one or more filters for modeling an acoustic path of ambient audio sounds from the location of the error microphone to the eardrum and having a response that generates a synthesized playback corrected error signal based on the error microphone signal, wherein the synthesized playback corrected error signal is indicative of ambient audio sounds present at the eardrum, and a coefficient control block that shapes the response of the adaptive filter in conformity with the filtered reference microphone signal and the synthesized playback corrected error signal by adapting the response of the adaptive filter to minimize the ambient audio sounds in the synthesized playback corrected error signal.

33 Claims, 4 Drawing Sheets

(56) References Cited

U.S. PATENT DOCUMENTS 5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,466,838 B1 12/2008 Moseley
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,249,262 B2 8/2012 Chua et al.
8,290,537 B2 10/2012 Lee et al.
8,325,934 B2 12/2012 Kuo
8,363,856 B2 1/2013 Lesso
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,948,407 B2 2/2015 Alderson et al.
8,958,571 B2 2/2015 Kwatra et al.
9,066,176 B2 6/2015 Hendrix et al.
9,094,744 B1 7/2015 Lu et al.
9,106,989 B2 8/2015 Li et al.
9,107,010 B2 8/2015 Abdollahzadeh Milani et al.
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.

(56) References Cited

U.S. PATENT DOCUMENTS

| | | | |
|---|---|---|---|
| 2010/0322430 | A1 | 12/2010 | Isberg |
| 2011/0002468 | A1 | 1/2011 | Tanghe |
| 2011/0007907 | A1 | 1/2011 | Park et al. |
| 2011/0026724 | A1 | 2/2011 | Doclo |
| 2011/0096933 | A1 | 4/2011 | Eastty |
| 2011/0106533 | A1 | 5/2011 | Yu |
| 2011/0116643 | A1 | 5/2011 | Tiscareno |
| 2011/0129098 | A1 | 6/2011 | Delano et al. |
| 2011/0130176 | A1 | 6/2011 | Magrath et al. |
| 2011/0144984 | A1 | 6/2011 | Konchitsky |
| 2011/0150257 | A1 | 6/2011 | Jensen |
| 2011/0158419 | A1 | 6/2011 | Theverapperuma et al. |
| 2011/0206214 | A1 | 8/2011 | Christoph et al. |
| 2011/0222698 | A1 | 9/2011 | Asao et al. |
| 2011/0222701 | A1 | 9/2011 | Donaldson et al. |
| 2011/0249826 | A1 | 10/2011 | Van Leest |
| 2011/0288860 | A1 | 11/2011 | Schevciw et al. |
| 2011/0293103 | A1 | 12/2011 | Park et al. |
| 2011/0299695 | A1 | 12/2011 | Nicholson |
| 2011/0305347 | A1 | 12/2011 | Wurm |
| 2011/0317848 | A1 | 12/2011 | Ivanov et al. |
| 2012/0057720 | A1 | 3/2012 | Van Leest |
| 2012/0084080 | A1 | 4/2012 | Konchitsky et al. |
| 2012/0135787 | A1 | 5/2012 | Kusunoki et al. |
| 2012/0140917 | A1 | 6/2012 | Nicholson et al. |
| 2012/0140942 | A1 | 6/2012 | Loeda |
| 2012/0140943 | A1 | 6/2012 | Hendrix et al. |
| 2012/0148062 | A1 | 6/2012 | Scarlett et al. |
| 2012/0155666 | A1 | 6/2012 | Nair |
| 2012/0170766 | A1 | 7/2012 | Alves et al. |
| 2012/0185524 | A1 | 7/2012 | Clark |
| 2012/0207317 | A1 | 8/2012 | Abdollahzadeh Milani et al. |
| 2012/0215519 | A1 | 8/2012 | Park et al. |
| 2012/0250873 | A1 | 10/2012 | Bakalos et al. |
| 2012/0259626 | A1 | 10/2012 | Li et al. |
| 2012/0263317 | A1 | 10/2012 | Shin et al. |
| 2012/0281850 | A1 | 11/2012 | Hyatt |
| 2012/0300958 | A1 | 11/2012 | Klemmensen |
| 2012/0300960 | A1 | 11/2012 | Mackay et al. |
| 2012/0308021 | A1 | 12/2012 | Kwatra et al. |
| 2012/0308024 | A1 | 12/2012 | Alderson et al. |
| 2012/0308025 | A1 | 12/2012 | Hendrix et al. |
| 2012/0308026 | A1 | 12/2012 | Kamath et al. |
| 2012/0308027 | A1 | 12/2012 | Kwatra |
| 2012/0308028 | A1 | 12/2012 | Kwatra et al. |
| 2012/0310640 | A1 | 12/2012 | Kwatra et al. |
| 2012/0316872 | A1 | 12/2012 | Stoltz et al. |
| 2013/0010982 | A1 | 1/2013 | Elko et al. |
| 2013/0083939 | A1 | 4/2013 | Fellers et al. |
| 2013/0156238 | A1 | 6/2013 | Birch et al. |
| 2013/0222516 | A1 | 8/2013 | Do et al. |
| 2013/0243198 | A1 | 9/2013 | Van Rumpt |
| 2013/0243225 | A1 | 9/2013 | Yokota |
| 2013/0259251 | A1 | 10/2013 | Bakalos |
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson |
| 2013/0315403 | A1 | 11/2013 | Samuelsson |
| 2013/0343556 | A1 | 12/2013 | Bright |
| 2013/0343571 | A1 | 12/2013 | Rayala et al. |
| 2014/0036127 | A1 | 2/2014 | Pong et al. |
| 2014/0044275 | A1 | 2/2014 | Goldstein et al. |
| 2014/0050332 | A1 | 2/2014 | Nielsen et al. |
| 2014/0051483 | A1 | 2/2014 | Schoerkmaier |
| 2014/0072134 | A1 | 3/2014 | Po et al. |
| 2014/0072135 | A1 | 3/2014 | Bajic et al. |
| 2014/0086425 | A1 | 3/2014 | Jensen et al. |
| 2014/0126735 | A1 | 5/2014 | Gauger, Jr. |
| 2014/0169579 | A1 | 6/2014 | Azmi |
| 2014/0177851 | A1 | 6/2014 | Kitazawa et al. |
| 2014/0177890 | A1 | 6/2014 | Hojlund et al. |
| 2014/0211953 | A1 | 7/2014 | Alderson et al. |
| 2014/0226827 | A1 | 8/2014 | Abdollahzadeh Milani et al. |
| 2014/0270223 | A1 | 9/2014 | Li et al. |
| 2014/0270224 | A1 | 9/2014 | Zhou et al. |
| 2014/0277022 | A1 | 9/2014 | Perrin et al. |
| 2014/0294182 | A1 | 10/2014 | Axelsson |
| 2014/0307887 | A1 | 10/2014 | Alderson et al. |
| 2014/0307888 | A1 | 10/2014 | Alderson et al. |
| 2014/0307890 | A1 | 10/2014 | Zhou et al. |
| 2014/0307899 | A1 | 10/2014 | Hendrix et al. |
| 2014/0314244 | A1 | 10/2014 | Yong et al. |
| 2014/0314246 | A1 | 10/2014 | Hellman |
| 2014/0314247 | A1 | 10/2014 | Zhang |
| 2014/0341388 | A1 | 11/2014 | Goldstein |
| 2014/0369517 | A1 | 12/2014 | Zhou et al. |
| 2015/0078572 | A1 | 3/2015 | Abdollahzadeh Milani et al. |
| 2015/0092953 | A1 | 4/2015 | Abdollahzadeh Milani et al. |
| 2015/0104032 | A1 | 4/2015 | Kwatra et al. |
| 2015/0161980 | A1 | 6/2015 | Alderson et al. |
| 2015/0161981 | A1 | 6/2015 | Kwatra |
| 2015/0163592 | A1 | 6/2015 | Alderson |
| 2015/0256660 | A1 | 9/2015 | Kaller et al. |
| 2015/0256953 | A1 | 9/2015 | Kwatra et al. |
| 2015/0269926 | A1 | 9/2015 | Alderson et al. |
| 2015/0365761 | A1 | 12/2015 | Alderson et al. |

FOREIGN PATENT DOCUMENTS

| | | | |
|---|---|---|---|
| CN | N105324810 | A | 2/2016 |
| DE | 102011013343 | A1 | 9/2012 |
| EP | 0412902 | A2 | 2/1991 |
| EP | 1691577 | A2 | 8/2006 |
| EP | 1880699 | A2 | 1/2008 |
| EP | 1947642 | A1 | 7/2008 |
| EP | 2133866 | A1 | 12/2009 |
| EP | 2237573 | A1 | 10/2010 |
| EP | 2216774 | A1 | 8/2011 |
| EP | 239550 | A1 | 12/2011 |
| EP | 2395501 | A1 | 12/2011 |
| EP | 2551845 | A1 | 1/2013 |
| EP | 2583074 | A1 | 4/2013 |
| EP | 2984648 | A2 | 2/2016 |
| EP | 2987160 | A1 | 2/2016 |
| EP | 2987162 | A1 | 2/2016 |
| EP | 2987337 | A1 | 2/2016 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| JP | 07325588 | A | 12/1995 |
| JP | 2006217542 | A | 8/2006 |
| JP | 105453170 | A | 3/2016 |
| WO | 9911045 | | 3/1999 |
| WO | 03015074 | A1 | 2/2003 |
| WO | 03015275 | A1 | 2/2003 |
| WO | WO2004009007 | A1 | 1/2004 |
| WO | 2004017303 | A1 | 2/2004 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |

(56) References Cited

FOREIGN PATENT DOCUMENTS

| | | | |
|---|---|---|---|
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |

OTHER PUBLICATIONS

Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
International Patent Application No. PCT/US2014/049600, International Search Report and Written Opinion, Jan. 14, 2015, 12 pages.
International Patent Application No. PCT/US2014/061753, International Search Report and Written Opinion, Feb. 9, 2015, 8 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.
Kuo, Sen and Tsai, Jianming, Residual noise shaping technique for active noise control systems, J. Acoust. Soc. Am. 95 (3), Mar. 1994, pp. 1665-1668.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint ", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages. (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

(56) References Cited

OTHER PUBLICATIONS

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, Jul. 23, 2015, 13 pages.
International Patent Application No. PCT/US2015/017124, International Search Report and Written Opinion, Jul. 13, 2015, 19 pages.
International Patent Application No. PCT/US2015/035073, International Search Report and Written Opinion, Oct. 8, 2015, 11 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).

VIRTUAL MICROPHONE FOR ADAPTIVE NOISE CANCELLATION IN PERSONAL AUDIO DEVICES

FIELD OF DISCLOSURE

The present disclosure relates in general to adaptive noise cancellation in connection with an acoustic transducer, and more particularly, to detection and cancellation of ambient noise present in the vicinity of the acoustic transducer, including applying models of a human ear canal to estimate ambient audio sounds present at a listener's eardrum.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Because the acoustic environment around personal audio devices, such as wireless telephones, can change dramatically, depending on the sources of noise that are present and the position of the device itself, it is desirable to adapt the noise canceling to take into account such environmental changes. For example, many adaptive noise canceling systems utilize an error microphone for sensing acoustic pressure proximate to an output of an electro-acoustic transducer (e.g., a loudspeaker) and generating an error microphone signal indicative of the sum of the acoustic output of the transducer and the ambient audio sounds at the transducer. When the transducer is close to a listener's ear, the error microphone signal may approximate the actual acoustic pressure at a listener's eardrum (a location known as a drum reference point). However, because of the distance between the drum reference point and the location of the error microphone (known as the error microphone reference point), the error microphone signal is only an approximation and not a perfect indication of acoustic pressure at the drum reference point. Thus, because noise cancellation attempts to reduce ambient audio sounds present at the error microphone reference point, the noise cancellation system may not cancel some noise present at the drum reference point.

SUMMARY

In accordance with the teachings of the present disclosure, the disadvantages and problems associated with existing approaches to adaptive noise cancellation may be reduced or eliminated.

In accordance with embodiments of the present disclosure, a personal audio device may include a personal audio device housing, a transducer, a reference microphone, an error microphone, and a processing circuit. The transducer may be coupled to the housing for reproducing an audio signal including both a source audio signal for playback to a listener and an anti-noise signal for countering the effects of ambient audio sounds in an acoustic output of the transducer. The reference microphone may be coupled to the housing for providing a reference microphone signal indicative of the ambient audio sounds. The error microphone may be coupled to the housing in proximity to the transducer for providing an error microphone signal indicative of the acoustic output of the transducer and the ambient audio sounds at the transducer.

The processing circuit may implement an adaptive filter having a response that generates an anti-noise signal from the reference microphone signal, one or more filters for modeling an electro-acoustic path of the anti-noise signal from a location of the error microphone to an eardrum of the listener and having a response that generates a filtered reference microphone signal from the reference microphone signal, one or more filters for modeling an acoustic path of the ambient audio sounds from the location of the error microphone to the eardrum and having a response that generates a synthesized playback corrected error signal based on the error microphone signal, wherein the synthesized playback corrected error signal is indicative of ambient audio sounds present at the eardrum, and a coefficient control block that shapes the response of the adaptive filter in conformity with the filtered reference microphone signal and the synthesized playback corrected error signal by adapting the response of the adaptive filter to minimize the ambient audio sounds in the synthesized playback corrected error signal.

In accordance with these and other embodiments of the present disclosure, a method for canceling ambient audio sounds in the proximity of a drum reference point of a user of a personal audio device may include receiving a reference microphone signal indicative of the ambient audio sounds. The method may also include receiving an error microphone signal indicative of the output of the transducer and the ambient audio sounds at the transducer. The method may further include generating a source audio signal for playback to a listener. The method may additionally include generating a filtered reference microphone signal from the reference microphone signal by filtering the reference microphone signal by one or more filters for modeling an electro-acoustic path of the anti-noise signal from a location of the error microphone to an eardrum of the listener. The method may also include generating a synthesized playback corrected error signal based on the error microphone signal by filtering the error microphone signal by one or more filters for modeling an acoustic path of the ambient audio sounds from the location of the error microphone to the eardrum, wherein the synthesized playback corrected error signal is indicative of ambient audio sounds present at the eardrum. The method may further include adaptively generating an anti-noise signal from the reference microphone signal, countering the effects of ambient audio sounds at an acoustic output of the transducer, by adapting, in conformity with the filtered reference microphone signal and the synthesized playback corrected error signal, a response of an adaptive filter that filters an output of the reference microphone to minimize the ambient audio sounds in the error microphone signal. The method may additionally include combining the anti-noise signal with the source audio signal to generate an audio signal provided to the transducer.

In accordance with these and other embodiments of the present disclosure, an integrated circuit may include an output, a reference microphone input, an error microphone input, and a processing circuit. The output may be for providing a signal to a transducer including both a source audio signal for playback to a listener and an anti-noise signal for countering the effect of ambient audio sounds in an acoustic output of the transducer. The reference microphone input may be for receiving a reference microphone signal indicative of the ambient audio sounds. The error microphone input may be for receiving an error microphone signal indicative of the output of the transducer and the ambient audio sounds at the transducer. The processing circuit may implement an adaptive filter having a response that generates an anti-noise signal from the reference microphone signal, one or more filters for modeling an electro-acoustic path of the anti-noise signal from a location of the error microphone to an eardrum of the listener and having a response that generates a filtered reference microphone signal from the reference microphone signal, one or more filters for modeling an acoustic path of the ambient audio sounds from the location of the error microphone to the eardrum and having a response that generates a synthesized playback corrected error signal based on the error microphone signal, wherein the synthesized playback corrected error signal is indicative of ambient audio sounds present at the eardrum, and a coefficient control block that shapes the response of the adaptive filter in conformity with the filtered reference microphone signal and the synthesized playback corrected error signal by adapting the response of the adaptive filter to minimize the ambient audio sounds in the synthesized playback corrected error signal.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
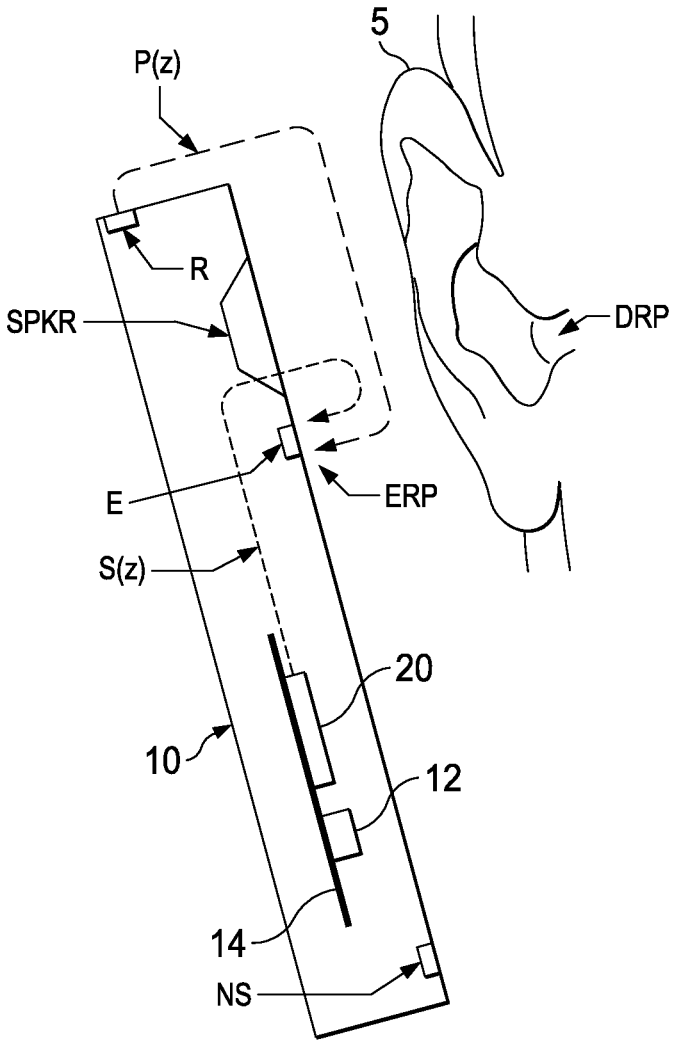
FIG. 1 is an illustration of an example wireless mobile telephone, in accordance with embodiments of the present disclosure.

The present disclosure encompasses noise canceling techniques and circuits that can be implemented in a personal audio device, such as a wireless telephone, earbud, or headphone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment, and an error microphone may be included for controlling the adaptation of the anti-noise signal to cancel the ambient audio sounds and for correcting for the electro-acoustic path from the output of the processing circuit through the transducer and to a listener's ear or eardrum Referring now to FIG. 1, a wireless telephone 10 as illustrated in accordance with embodiments of the present disclosure is shown in proximity to a human ear 5. Wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5 at an error microphone reference position ERP, when wireless telephone 10 is in close proximity to ear 5. Circuit 14 within wireless telephone 10 may include an audio CODEC integrated circuit (IC) 20 that receives the signals from reference microphone R, near-speech microphone NS, and error microphone E, and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E (e.g., at error microphone reference position ERP). Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is pressed to ear 5. Because the listener of wireless telephone actually hears the output of speaker SPKR at a drum reference point DRP, differences between the error microphone reference signal produced by error microphone E and what is actually heard by the listener are shaped by the response of the ear canal, as well as a spatial distance between error microphone reference position ERP and drum reference position DRP.

While the illustrated wireless telephone 10 includes a two-microphone ANC system with a third near-speech microphone NS, some aspects of the present disclosure may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure. In addition, some aspects of the present disclosure may be practiced in a system that includes a plurality of reference microphones and/or a plurality of error microphones.

Figure 2:
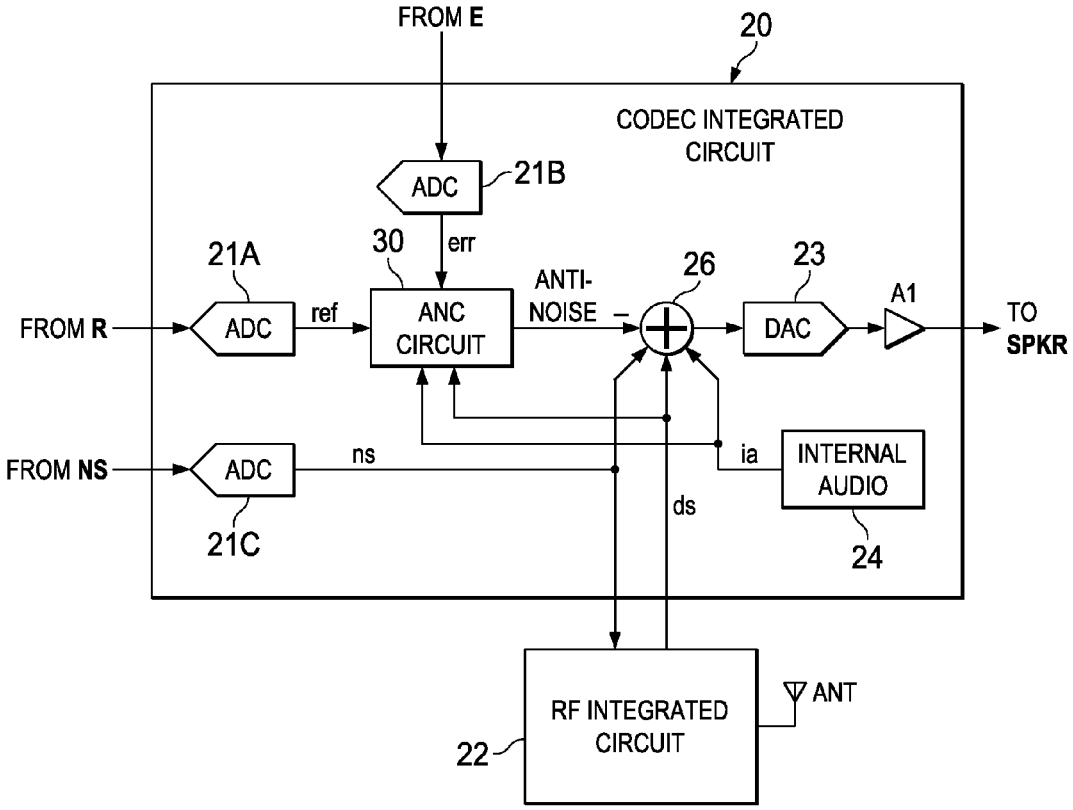
FIG. 2 is a block diagram of selected circuits within the wireless telephone depicted in FIG. 1, in accordance with embodiments of the present disclosure.

Referring now to FIG. 2, selected circuits within wireless telephone 10 are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3A:
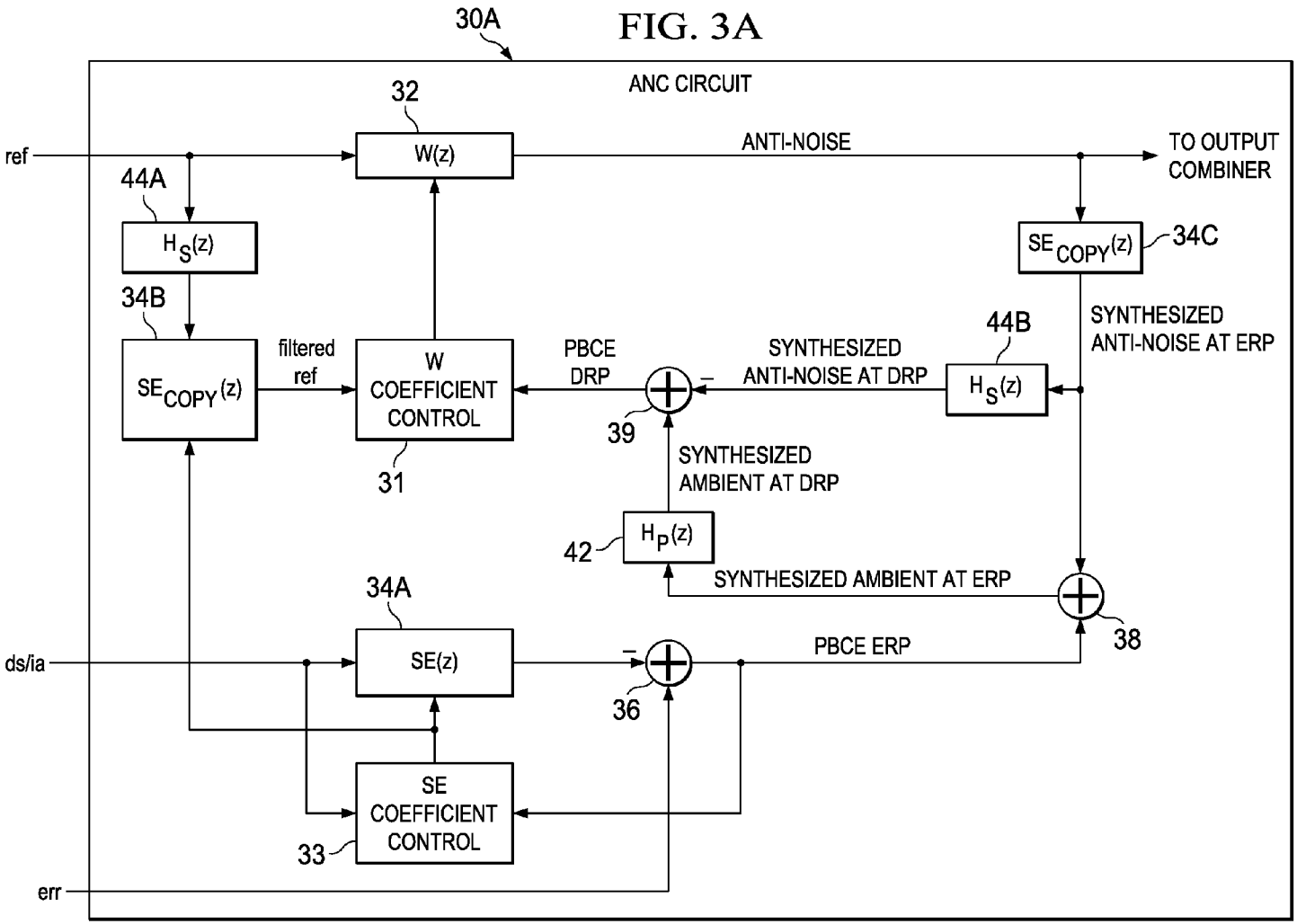
FIG. 3A is a block diagram depicting selected signal processing circuits and functional blocks within an example active noise canceling (ANC) circuit of a coder-decoder (CODEC) integrated circuit of FIG. 2, in accordance with embodiments of the present disclosure.

Referring now to FIG. 3A, details of an example ANC circuit 30A are shown in accordance with embodiments of the present disclosure. Adaptive filter 32 may receive a filtered reference microphone signal filtered_ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of the filtered reference microphone signal filtered_ref present in a synthesized playback corrected error signal PBCE DRP described in greater detail below. The signals compared by W coefficient control block 31 may be the reference microphone signal ref as shaped by a secondary ear canal path estimate filter 44A for modeling an acoustic path of the anti-noise signal from the location of the error microphone to the eardrum and a copy of an estimate of the response of path S(z) provided by filter 34B (thus generating the filtered reference signal filtered_ref) and a synthesized playback corrected error signal (shown in FIG. 3A as "PBCE DRP") based at least in part on error microphone signal err. By transforming reference microphone signal ref with an estimate of the response of the acoustic path of the anti-noise signal from the location of the error microphone to the eardrum, response $H_S(z)$, and a copy of the estimate of the response of path S(z), response $SE_{COPY}(z)$, an estimate of the cumulative electro-acoustical path of reference microphone signal ref from reference microphone R to the DRP is applied to reference microphone signal ref, thus balancing the inputs to W coefficient control block 31, and providing for robustness of adaptive filter 32. By minimizing the difference between the filtered reference signal and the synthesized playback corrected error signal, adaptive filter 32 may adapt to the desired response of P(z)/S(z).

To generate the synthesized playback corrected error signal, ANC circuit 30A may generate a playback corrected error at the ERP (shown in FIG. 3A as "PBCE ERP") which comprises the error microphone signal combined (e.g., at combiner 36) with an inverted amount of source audio signal (e.g., downlink audio signal ds and/or internal audio signal ia) that has been processed by filter 34A having response SE(z), of which response $SE_{COPY}(z)$ is a copy. By injecting an inverted amount of source audio signal, adaptive filter 32 may be prevented from adapting to the relatively large amount of source audio signal present in error microphone signal err (and thus also present in the synthesized playback corrected error signal which is based at least in part on error microphone signal err) and by transforming that inverted copy of the source audio signal with the estimate of the response of path S(z), the source audio signal that is removed from error microphone signal err should match the expected version of the source audio signal reproduced at the ERP, because the electrical and acoustical path of S(z) is the path taken by the source audio signal to arrive at error microphone E.

ANC circuit 30A may also generate a synthesized error reference point anti-noise signal (shown in FIG. 3A as "SYNTHESIZED ANTI-NOISE AT ERP") by shaping the anti-noise signal generated by filter 32 with filter 34C having a response $SE_{COPY}(z)$ which is a copy of response SE(z). Such synthesized error reference point anti-noise signal should match the expected version of the anti-noise signal reproduced at the ERP, because the electrical and acoustical path of S(z) is the path taken by the anti-noise signal to arrive at error microphone E.

The synthesized error reference point anti-noise signal may be combined (e.g., by combiner 38) with the playback corrected error at the ERP to generate a synthesized error reference point ambient signal (shown in FIG. 3A as "SYNTHESIZED AMBIENT AT ERP") indicative of the ambient audio sounds present at the ERP. The synthesized error reference point ambient signal may be shaped by a primary ear canal path estimate filter 42 with a response $H_P(z)$ for modeling an acoustic path of the ambient audio sounds from the location of the error microphone E (the ERP) to the DRP, thus generating a synthesized drum reference point ambient signal indicative of the ambient audio sounds present at the DRP (shown in FIG. 3A as "SYNTHESIZED AMBIENT AT DRP").

Furthermore, ANC circuit 30A may also generate a synthesized drum reference point anti-noise signal (shown in FIG. 3A as "SYNTHESIZED ANTI-NOISE AT DRP") by shaping the synthesized error reference point anti-noise signal generated by filter 34C with a secondary ear canal path estimate filter 44B having a response $H_S(z)$ which may be a copy of the response of secondary ear canal path estimate filter 44A. Such synthesized drum reference point anti-noise signal should match the expected version of the anti-noise signal reproduced at the DRFP, because the electrical and acoustical path of $H_S(z)$ is the path taken by the synthesized error reference point anti-noise signal to arrive at the DRP.

The synthesized playback corrected error may be generated by subtracting (e.g., by combiner 39) the synthesized drum reference point anti-noise signal from the synthesized drum reference point ambient signal. The resulting synthesized playback corrected error may be indicative of the playback corrected error at the drum reference point.

Figure 3B:
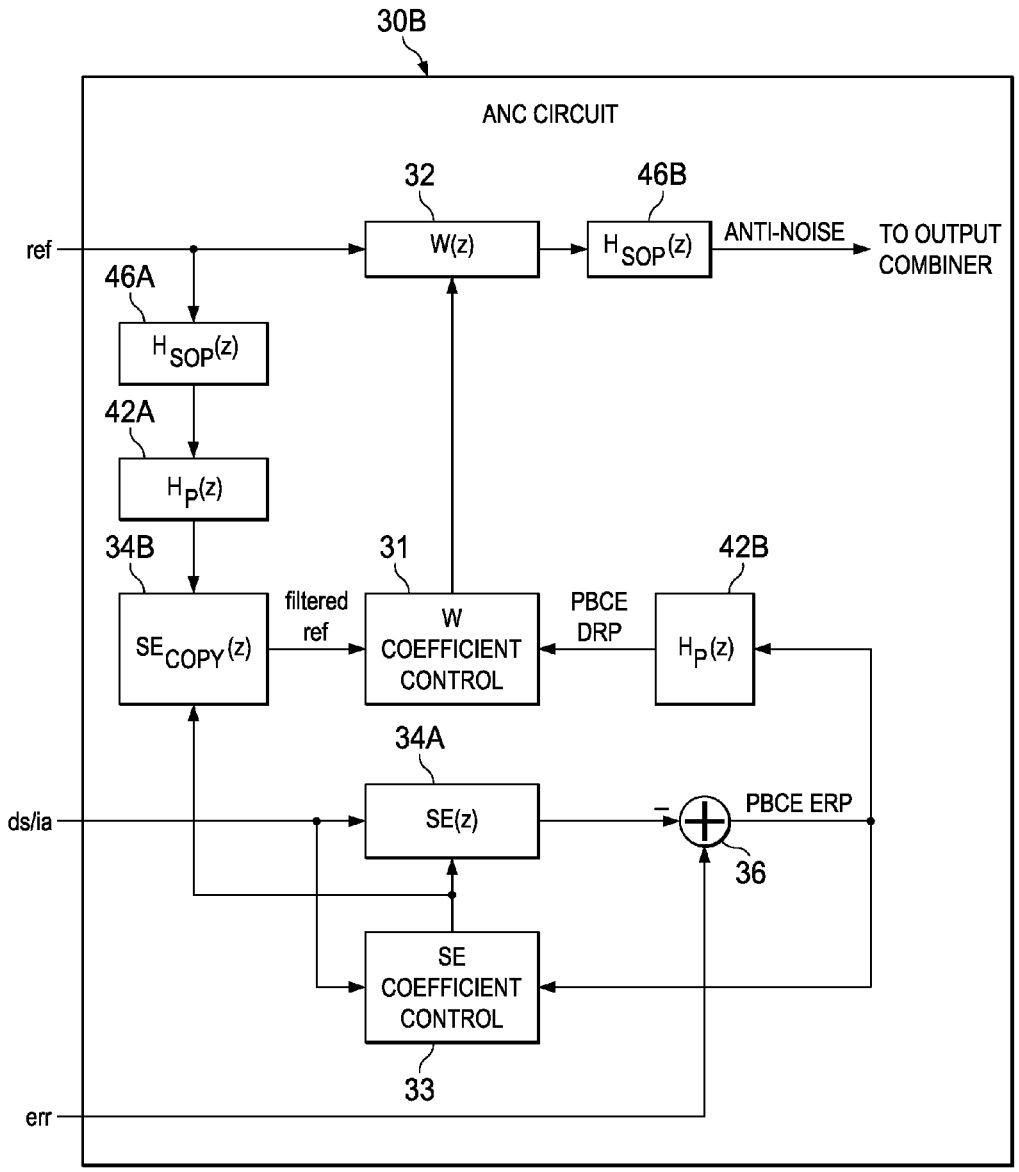
FIG. 3B is a block diagram depicting selected signal processing circuits and functional blocks within another example ANC circuit of a CODEC integrated circuit of FIG. 2, in accordance with embodiments of the present disclosure.

Referring now to FIG. 3B, details of an example ANC circuit 30B are shown in accordance with embodiments of the present disclosure. Adaptive filter 32 may receive a filtered reference microphone signal filtered_ref indicative of the expected version of reference microphone signal ref reproduced at the DRP and under ideal circumstances, may adapt its transfer function W(z) to be P(z)/S(z) to generate a signal which, when further shaped by a canal path estimate filter 46B having a response $H_{SOP}(z)$ for modeling a ratio between a model of an acoustic path of the anti-noise signal from the location of the error microphone to the eardrum (e.g., response $H_S(z)$ described in reference to ANC circuit 30A) and a model of the acoustic path of the ambient audio sounds from the location of the error microphone to the eardrum (e.g., response $H_P(z)$ described in reference to ANC circuit 30A), generates the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of the filtered reference microphone signal filtered_ref present in a synthesized playback corrected error signal PBCE DRP described in greater detail below. The signals compared by W coefficient control block 31 may be a synthesized playback corrected error signal (shown in FIG. 3B as "PBCE DRP") based at least in part on error microphone signal err and the reference microphone signal ref as shaped by: (i) a canal path estimate filter 46A having a response $H_{SOP}(z)$ similar or identical to the response of canal path estimate filter 46B for modeling a ratio between a model of an acoustic path of the anti-noise signal from the location of the error microphone to the eardrum (e.g., response $H_S(z)$ described in reference to ANC circuit 30A) and a model of the acoustic path of the ambient audio sounds from the location of the error microphone to the eardrum (e.g., response $H_P(z)$ described in reference to ANC circuit 30A); (ii) a primary ear canal path estimate filter 42A with a response $H_P(z)$ for modeling an acoustic path of the ambient audio sounds from the location of the error microphone E (the ERP) to the DRP; and (iii) a copy of an estimate of the response of path S(z) provided by filter 34B (thus generating the filtered reference signal filtered_ref). The cumulative effect of filters 46A, 42A, and 34B may be to balance the inputs to W coefficient control block 31, and providing for robustness of adaptive filter 32. By minimizing the difference between the filtered reference signal and the synthesized playback corrected error signal, adaptive filter 32 may adapt to the desired response of P(z)/S(z).

To generate the synthesized playback corrected error signal, ANC circuit 30B may generate a playback corrected error at the ERP (shown in FIG. 3A as "PBCE ERP") which comprises the error microphone signal combined (e.g., at combiner 36) with an inverted amount of source audio signal (e.g., downlink audio signal ds and/or internal audio signal ia) that has been processed by filter 34A having response SE(z), of which response $SE_{COPY}(z)$ is a copy. By injecting an inverted amount of source audio signal, adaptive filter 32 may be prevented from adapting to the relatively large amount of source audio signal present in error microphone signal err (and thus also present in the synthesized playback corrected error signal which is based at least in part on error microphone signal err) and by transforming that inverted copy of the source audio signal with the estimate of the response of path S(z), the source audio signal that is removed from error microphone signal err should match the expected version of the source audio signal reproduced at the ERP, because the electrical and acoustical path of S(z) is the path taken by the source audio signal to arrive at error microphone E.

The playback corrected error may be shaped by a primary ear canal path estimate filter 42B with a response $H_P(z)$ for modeling an acoustic path of the ambient audio sounds from the location of the error microphone E (the ERP) to the DRP, thus generating the synthesized playback corrected error. The resulting synthesized playback corrected error may be indicative of the playback corrected error at the drum reference point.

In some embodiments of the ANC circuits 30A and 30B respectively depicted in FIGS. 3A and 3B, the responses SE(z) and $SE_{COPY}(z)$ may be adaptive. Accordingly, adaptive filter 34A may have coefficients controlled by SE coefficient control block 33, which may compare a source audio signal (e.g., downlink audio signal ds and/or internal audio signal ia) and the playback corrected error. SE coefficient control block 33 may correlate the actual source audio signal with the components of the source audio signal that are present in error microphone signal err. Adaptive filter 34A may thereby be adapted to generate a secondary estimate signal from the source audio signal, that when subtracted from error microphone signal err to generate the playback corrected error, includes the content of error microphone signal err that is not due to the source audio signal. Filters 34B and 34C may not be adaptive filters, per se, but may have adjustable responses that are tuned to match the response of adaptive filter 34A, so that the responses of filters 34B and 34C track the adapting of adaptive filter 34A.

In some embodiments, the various responses $H_P(z)$, $H_S(z)$, and/or $H_{SOP}(z)$ for modeling acoustic paths of signals from the ERP to the DRP may be determined by offline modeling of a human ear canal.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A personal audio device comprising:

a personal audio device housing;

a transducer coupled to the housing for reproducing an audio signal including both a source audio signal for playback to a listener and an anti-noise signal for countering the effects of ambient audio sounds in an acoustic output of the transducer;

a reference microphone coupled to the housing for providing a reference microphone signal indicative of the ambient audio sounds;

an error microphone coupled to the housing in proximity to the transducer for providing an error microphone signal indicative of the acoustic output of the transducer and the ambient audio sounds at the transducer; and a processing circuit that implements:

an adaptive filter having a response that generates an anti-noise signal from the reference microphone signal;

one or more filters for modeling an electro-acoustic path of the anti-noise signal from a location of the error microphone to an eardrum of the listener and having a response that generates a filtered reference microphone signal from the reference microphone signal;

one or more filters for modeling an acoustic path of the ambient audio sounds from the location of the error microphone to the eardrum and having a response that generates a synthesized playback corrected error signal based on the error microphone signal, wherein the synthesized playback corrected error signal is indicative of ambient audio sounds present at the eardrum; and a coefficient control block that shapes the response of the adaptive filter in conformity with the filtered reference microphone signal and the synthesized playback corrected error signal by adapting the response of the adaptive filter to minimize the ambient audio sounds in the synthesized playback corrected error signal.

2. The personal audio device of claim 1, wherein the processing circuit further implements a secondary path estimate filter for modeling an electro-acoustic path of the source audio signal having a response that generates a secondary path estimate from the source audio signal.

3. The personal audio device of claim 2, wherein:

the one or more filters for modeling the electro-acoustic path of the anti-noise signal from the location of the error microphone to the eardrum of the listener comprise:

a first secondary ear canal path estimate filter for modeling an acoustic path of the anti-noise signal from the location of the error microphone to the eardrum; and a filter for modeling an electro-acoustic path of the reference microphone signal to the transducer; and the one or more filters for modeling the acoustic path of the ambient audio sounds from the location of the error microphone to the eardrum comprise:

a filter for modeling an electro-acoustic path of the anti-noise signal to the transducer having a response that generates a synthesized error reference point anti-noise signal from the anti-noise signal;

a second secondary ear canal path estimate filter for modeling an acoustic path of the anti-noise signal from the location of the error microphone to the eardrum having a response that generates a synthesized drum reference point anti-noise signal from the synthesized error reference point anti-noise signal; and a primary ear canal path estimate filter for modeling an acoustic path of the ambient audio sounds from the location of the error microphone to the eardrum and having a response that generates a synthesized drum reference point ambient signal from the synthesized error reference point anti-noise signal and a playback corrected error, wherein the playback corrected error is based on a difference between the error microphone signal and the source audio signal; and the synthesized playback corrected error is based on a difference between the synthesized drum reference point ambient signal and the synthesized drum reference point anti-noise signal.

4. The personal audio device of claim 3, wherein at least one of the filter for modeling the electro-acoustic path of the reference microphone signal to the transducer and the filter for modeling the electro-acoustic path of the anti-noise signal to the transducer has a response equal to the response of the secondary path estimate filter.

5. The personal audio device of claim 3, wherein the filter for modeling an electro-acoustic path of the reference microphone signal to the transducer and the filter for modeling an electro-acoustic path of the anti-noise signal to the transducer have the same response.

6. The personal audio device of claim 3, wherein the first secondary ear canal path estimate filter and the second secondary ear canal path estimate filter have the same response.

7. The personal audio device of claim 2, wherein:

the one or more filters for modeling the electro-acoustic path of the anti-noise signal from the location of the error microphone to the eardrum of the listener comprise:

a first primary ear canal path estimate filter for modeling an acoustic path of the ambient audio sounds from the location of the error microphone to the eardrum;

a first canal path estimate filter for modeling a ratio between a model of an acoustic path of the anti-noise signal from the location of the error microphone to the eardrum and a model of the acoustic path of the ambient audio sounds from the location of the error microphone to the eardrum; and a filter for modeling an electro-acoustic path of the reference microphone signal to the transducer;

the one or more filters for modeling the acoustic path of the ambient audio sounds from the location of the error microphone to the eardrum comprise a second ear canal path estimate filter for modeling an acoustic path of the ambient audio sounds from the location of the error microphone to the eardrum and having a response that generates a synthesized drum reference point ambient signal from a playback corrected error, wherein the playback corrected error is based on a difference between the error microphone signal and the source audio signal; and wherein the processing circuit further implements a second canal path estimate filter for modeling the ratio between the model of an acoustic path of the anti-noise signal from the location of the error microphone to the eardrum and the model of the acoustic path of the ambient audio sounds from the location of the error microphone to the eardrum, wherein the second canal path estimate filter and the adaptive filter are configured to together generate the anti-noise signal from the reference microphone signal.

8. The personal audio device of claim 7, wherein the filter for modeling the electro-acoustic path of the reference microphone signal to the transducer has a response equal to the response of the secondary path estimate filter.

9. The personal audio device of claim 7, wherein the first primary ear canal path estimate filter and the second primary ear canal path estimate filter have the same response.

10. The personal audio device of claim 7, wherein the first canal path estimate filter and the second canal path estimate filter have the same response.

11. The personal audio device of claim 2, wherein the secondary path estimate filter is adaptive, and the processing circuit further implements a secondary coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the source audio signal.

12. A method for canceling ambient audio sounds in the proximity of a drum reference point of a user of a personal audio device, the method comprising:

receiving a reference microphone signal indicative of the ambient audio sounds;

receiving an error microphone signal indicative of an output of a transducer and the ambient audio sounds at the transducer;

generating a source audio signal for playback to a listener;

generating a filtered reference microphone signal from the reference microphone signal by filtering the reference microphone signal by one or more filters for modeling an electro-acoustic path of the anti-noise signal from a location of the error microphone to an eardrum of the listener;

generating a synthesized playback corrected error signal based on the error microphone signal by filtering the error microphone signal by one or more filters for modeling an acoustic path of the ambient audio sounds from the location of the error microphone to the eardrum, wherein the synthesized playback corrected error signal is indicative of ambient audio sounds present at the eardrum;

adaptively generating an anti-noise signal from the reference microphone signal, countering the effects of ambient audio sounds at an acoustic output of the transducer, by adapting, in conformity with the filtered reference microphone signal and the synthesized playback corrected error signal, a response of an adaptive filter that filters an output of the reference microphone to minimize the ambient audio sounds in the error microphone signal; and combining the anti-noise signal with the source audio signal to generate an audio signal provided to the transducer.

13. The method of claim 12, further comprising generating a secondary path estimate from the source audio signal by filtering the source audio signal with a secondary path estimate filter modeling an electro-acoustic path of the source audio signal.

14. The method of claim 13, wherein:

the one or more filters for modeling the electro-acoustic path of the anti-noise signal from the location of the error microphone to the eardrum of the listener comprise:

a first secondary ear canal path estimate filter for modeling an acoustic path of the anti-noise signal from the location of the error microphone to the eardrum; and a filter for modeling an electro-acoustic path of the reference microphone signal to the transducer; and the one or more filters for modeling the acoustic path of the ambient audio sounds from the location of the error microphone to the eardrum comprise:

a filter for modeling an electro-acoustic path of the anti-noise signal to the transducer having a response that generates a synthesized error reference point anti-noise signal from the anti-noise signal;

a second secondary ear canal path estimate filter for modeling an acoustic path of the anti-noise signal from the location of the error microphone to the eardrum having a response that generates a synthesized drum reference point anti-noise signal from the synthesized error reference point anti-noise signal; and a primary ear canal path estimate filter for modeling an acoustic path of the ambient audio sounds from the location of the error microphone to the eardrum and having a response that generates a synthesized drum reference point ambient signal from the synthesized error reference point anti-noise signal and a playback corrected error, wherein the playback corrected error is based on a difference between the error microphone signal and the source audio signal; and the synthesized playback corrected error is based on a difference between the synthesized drum reference point ambient signal and the synthesized drum reference point anti-noise signal.

15. The method of claim 14, wherein at least one of the filter for modeling the electro-acoustic path of the reference microphone signal to the transducer and the filter for modeling the electro-acoustic path of the anti-noise signal to the transducer has a response equal to the response of the secondary path estimate filter.

16. The method of claim 14, wherein the filter for modeling an electro-acoustic path of the reference microphone signal to the transducer and the filter for modeling an electro-acoustic path of the anti-noise signal to the transducer have the same response.

17. The method of claim 14, wherein the first secondary ear canal path estimate filter and the second secondary ear canal path estimate filter have the same response.

18. The method of claim 13, wherein:

the one or more filters for modeling the electro-acoustic path of the anti-noise signal from the location of the error microphone to the eardrum of the listener comprise:

a first primary ear canal path estimate filter for modeling an acoustic path of the ambient audio sounds from the location of the error microphone to the eardrum;

a first canal path estimate filter for modeling a ratio between a model of an acoustic path of the anti-noise signal from the location of the error microphone to the eardrum and a model of the acoustic path of the ambient audio sounds from the location of the error microphone to the eardrum; and a filter for modeling an electro-acoustic path of the reference microphone signal to the transducer;

the one or more filters for modeling the acoustic path of the ambient audio sounds from the location of the error microphone to the eardrum comprise a second ear canal path estimate filter for modeling an acoustic path of the ambient audio sounds from the location of the error microphone to the eardrum and having a response that generates a synthesized drum reference point ambient signal from a playback corrected error, wherein the playback corrected error is based on a difference between the error microphone signal and the source audio signal; and wherein the processing circuit further implements a second canal path estimate filter for modeling the ratio between the model of an acoustic path of the anti-noise signal from the location of the error microphone to the eardrum and the model of the acoustic path of the ambient audio sounds from the location of the error microphone to the eardrum, wherein the second canal path estimate filter and the adaptive filter are configured to together generate the anti-noise signal from the reference microphone signal.

19. The method of claim 18, wherein the filter for modeling the electro-acoustic path of the reference microphone signal to the transducer has a response equal to the response of the secondary path estimate filter.

20. The method of claim 18, wherein the first primary ear canal path estimate filter and the second primary ear canal path estimate filter have the same response.

21. The method of claim 18, wherein the first canal path estimate filter and the second canal path estimate filter have the same response.

22. The method of claim 13, wherein the secondary path estimate filter is adaptive, and the response of the secondary path estimate filter is shaped in conformity with the source audio signal and a playback corrected error by adapting the response of the secondary path estimate filter to minimize the playback corrected error, wherein the playback corrected error is based on a difference between the error microphone signal and the source audio signal.

23. An integrated circuit comprising:

an output for providing a signal to a transducer including both a source audio signal for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

an adaptive filter having a response that generates an anti-noise signal from the reference microphone signal;

one or more filters for modeling an electro-acoustic path of the anti-noise signal from a location of the error microphone to an eardrum of the listener and having a response that generates a filtered reference microphone signal from the reference microphone signal;

one or more filters for modeling an acoustic path of the ambient audio sounds from the location of the error microphone to the eardrum and having a response that generates a synthesized playback corrected error signal based on the error microphone signal, wherein the synthesized playback corrected error signal is indicative of ambient audio sounds present at the eardrum; and a coefficient control block that shapes the response of the adaptive filter in conformity with the filtered reference microphone signal and the synthesized playback corrected error signal by adapting the response of the adaptive filter to minimize the ambient audio sounds in the synthesized playback corrected error signal.

24. The integrated circuit of claim 23, wherein the processing circuit further implements a secondary path estimate filter for modeling an electro-acoustic path of the source audio signal having a response that generates a secondary path estimate from the source audio signal.

25. The integrated circuit of claim 24, wherein:

the one or more filters for modeling the electro-acoustic path of the anti-noise signal from the location of the error microphone to the eardrum of the listener comprise:

a first secondary ear canal path estimate filter for modeling an acoustic path of the anti-noise signal from the location of the error microphone to the eardrum; and a filter for modeling an electro-acoustic path of the reference microphone signal to the transducer; and the one or more filters for modeling the acoustic path of the ambient audio sounds from the location of the error microphone to the eardrum comprise:

a filter for modeling an electro-acoustic path of the anti-noise signal to the transducer having a response that generates a synthesized error reference point anti-noise signal from the anti-noise signal;

a second secondary ear canal path estimate filter for modeling an acoustic path of the anti-noise signal from the location of the error microphone to the eardrum having a response that generates a synthesized drum reference point anti-noise signal from the synthesized error reference point anti-noise signal; and a primary ear canal path estimate filter for modeling an acoustic path of the ambient audio sounds from the location of the error microphone to the eardrum and having a response that generates a synthesized drum reference point ambient signal from the synthesized error reference point anti-noise signal and a playback corrected error, wherein the playback corrected error is based on a difference between the error microphone signal and the source audio signal; and the synthesized playback corrected error is based on a difference between the synthesized drum reference point ambient signal and the synthesized drum reference point anti-noise signal.

26. The integrated circuit of claim 25, wherein at least one of the filter for modeling the electro-acoustic path of the reference microphone signal to the transducer and the filter for modeling the electro-acoustic path of the anti-noise signal to the transducer has a response equal to the response of the secondary path estimate filter.

27. The integrated circuit of claim 25, wherein the filter for modeling an electro-acoustic path of the reference microphone signal to the transducer and the filter for modeling an electro-acoustic path of the anti-noise signal to the transducer have the same response.

28. The integrated circuit of claim 25, wherein the first secondary ear canal path estimate filter and the second secondary ear canal path estimate filter have the same response.

29. The integrated circuit of claim 24, wherein:

the one or more filters for modeling the electro-acoustic path of the anti-noise signal from the location of the error microphone to the eardrum of the listener comprises:

a first primary ear canal path estimate filter for modeling an acoustic path of the ambient audio sounds from the location of the error microphone to the eardrum;

a first canal path estimate filter for modeling a ratio between a model of an acoustic path of the anti-noise signal from the location of the error microphone to the eardrum and a model of the acoustic path of the ambient audio sounds from the location of the error microphone to the eardrum; and a filter for modeling an electro-acoustic path of the reference microphone signal to the transducer;

the one or more filters for modeling the acoustic path of the ambient audio sounds from the location of the error microphone to the eardrum comprise a second ear canal path estimate filter for modeling an acoustic path of the ambient audio sounds from the location of the error microphone to the eardrum and having a response that generates a synthesized drum reference point ambient signal from a playback corrected error, wherein the playback corrected error is based on a difference between the error microphone signal and the source audio signal; and wherein the processing circuit further implements a second canal path estimate filter for modeling the ratio between the model of an acoustic path of the anti-noise signal from the location of the error microphone to the eardrum and the model of the acoustic path of the ambient audio sounds from the location of the error microphone to the eardrum, wherein the second canal path estimate filter and the adaptive filter are configured to together generate the anti-noise signal from the reference microphone signal.

30. The integrated circuit of claim 29, wherein the filter for modeling the electro-acoustic path of the reference microphone signal to the transducer has a response equal to the response of the secondary path estimate filter.

31. The integrated circuit of claim 29, wherein the first primary ear canal path estimate filter and the second primary ear canal path estimate filter have the same response.

32. The integrated circuit of claim 29, wherein the first canal path estimate filter and the second canal path estimate filter have the same response.

33. The integrated circuit of claim 24, wherein the secondary path estimate filter is adaptive, and the processing circuit further implements a secondary coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the source audio signal.

* * * * *